US007898515B2

(12) United States Patent
Moon et al.

(10) Patent No.: US 7,898,515 B2
(45) Date of Patent: Mar. 1, 2011

(54) LIQUID CRYSTAL DISPLAY

(75) Inventors: Su Hwan Moon, Gyeongsangbuk-do (KR); Do Heon Kim, Busan (KR); Ji Eun Chae, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 934 days.

(21) Appl. No.: 11/299,629

(22) Filed: Dec. 13, 2005

(65) Prior Publication Data

US 2007/0001957 A1 Jan. 4, 2007

(30) Foreign Application Priority Data

Jun. 30, 2005 (KR) ..... 10-2005-0058405

(51) Int. Cl.
*G09G 3/36* (2006.01)

(52) U.S. Cl. ..... 345/96

(58) Field of Classification Search ..... 345/94, 345/96, 87, 98, 141, 92
See application file for complete search history.

(56) References Cited

U.S. PATENT DOCUMENTS 6,177,970 B1 * 1/2001 Kim ..... 349/43
7,002,543 B2 * 2/2006 Miyajima et al. ..... 345/94
2005/0001807 A1 * 1/2005 Lee et al. ..... 345/92
2005/0088392 A1 * 4/2005 Kim et al. ..... 345/94
2005/0094079 A1 * 5/2005 Yoo et al. ..... 349/141
2005/0140637 A1 * 6/2005 Yi ..... 345/98
2005/0168425 A1 * 8/2005 Takada et al. ..... 345/94
2005/0212743 A1 * 9/2005 Yokoyama et al. ..... 345/94
2006/0145990 A1 * 7/2006 Kim et al. ..... 345/94

FOREIGN PATENT DOCUMENTS

JP 04360192 A * 12/1992

* cited by examiner

*Primary Examiner* — Quan-Zhen Wang
*Assistant Examiner* — Tony Davis
(74) *Attorney, Agent, or Firm* — Morgan, Lewis & Bockius LLP

(57) ABSTRACT

A liquid crystal display device includes a plurality of pixel electrodes to which a data voltage is supplied, a plurality of common electrodes arranged to form electric fields with the pixel electrodes, a plurality of common wire lines commonly connected to the common electrodes in each horizontal line, a plurality of common voltage drive circuits to supply a common voltage to each of the corresponding common wire lines, and a controller for generating clock signals to control the common voltage drive circuits to invert an electric potential of the common voltage to be output from each of the common voltage drive circuits for each frame period.

5 Claims, 7 Drawing Sheets

LIQUID CRYSTAL DISPLAY

This application claims the benefit of the Korean Patent Application No. P2005-0058405 filed on Jun. 30, 2005, which is hereby incorporated by reference.

BACKGROUND OF THE INVENTION

1. Field of the Invention

The present invention relates to a liquid crystal display device, and more particularly, to an in-plane mode liquid crystal display device.

2. Discussion of the Related Art

A liquid crystal display (LCD) device controls an electric field applied to a liquid crystal cell to modulate light incident to the liquid crystal cell, thereby displaying a picture. The LCD device can be classified into a vertical electric field type and a horizontal electric field type in accordance with a direction of an electric field generated to drive liquid crystals in the liquid crystal cell.

The vertical electric field type LCD device includes a pixel electrode and a common electrode vertically opposed to each other on a first substrate and a second substrate, respectively, which are also vertically opposite to each other. When a voltage is applied to the electrodes, an electric field in a vertical direction is generated and applied to the liquid crystal cell. The vertical electric field type LCD device generally provides a relatively wide aperture ratio. However, the vertical electric field type LCD device generally has a narrow viewing angle. A typical liquid crystal mode of the vertical electric field type LCD device is a twisted nematic mode (hereinafter, referred to as "TN mode").

In the TN mode, liquid crystal molecules 13 are located between a first glass substrate 14 and a second glass substrate 12, as shown in FIGS. 1A and 1B. A first polarizer 15 having a light transmission axis of a specific direction is formed on a light exiting plane of the first glass substrate 14. Similarly, a second polarizer 11 of the light transmission axis, which perpendicularly crosses the light transmission axis of the first polarizer 15, is formed on the light incident plane of the second glass substrate 12. Further, in the TN mode, a transparent electrode (not shown) is formed on each of the first and second glass substrates, and an alignment film (not shown) is formed to set a pre-tilt angle.

The operation of the TN mode is described as follows using a normally white mode TN mode LCD device as an example. When there is no voltage applied to the transparent electrodes (i.e., inactive state), local optical axes (i.e., director) of the liquid crystal molecules in a liquid crystal layer are continuously twisted by 90° between the first glass substrate 14 and the second glass substrate 12. Therefore, polarized direction of a linearly polarized light incident through the polarizer 11 of the second glass substrate 12 follows the optical axes of the twisted liquid crystal molecules, thereby passing through the polarizer 15 of the first glass substrate 14 as shown in FIG. 1A. Hence, the LCD device is normally in a "white" state when no voltage is applied.

In contrast, when a voltage is applied to the transparent electrodes (i.e., active state), an electric field is generated by the voltage difference between the transparent electrodes. The generated electric field forces the normally twisted liquid crystal molecules 13 to align in the direction of the electric field, thereby becoming untwisted. As a result, the light axes of a central part of the liquid crystal layer become parallel to the electric field. As the linearly polarized light incident through the polarizer 11 passes through the untwisted liquid crystal layer, its polarized direction remains intact. Hence, the linearly polarized light is blocked by the first glass substrate 14 as shown in FIG. 1B.

In the TN mode, a wide viewing angle is difficult to achieve because its contrast ratio and brightness vary significantly in accordance with the viewing angle. In general, horizontal electric field type LCD device has a wider viewing angle than the vertical type TN mode LCD device. A representative liquid crystal mode of the horizontal electric field type LCD device is an in-plane switching mode (hereinafter, referred to as "IPS mode").

In the IPS mode, an electric field is generated between electrodes formed on the same substrate and the liquid crystal molecules are driven by the in-plane electric field. In the IPS mode as shown in FIG. 2, a pixel electrode 21 and a common electrode 22 are formed on the same glass substrate. Accordingly, a wide viewing angle is achieved because a liquid crystal 23 is substantially driven within a horizontal plane by the electric field applied between the electrodes 21 and 22.

FIG. 3 shows a schematic diagram illustrating an array arrangement of an IPS mode according to the related art. As shown in FIG. 3, an IPS mode LCD device includes a thin film transistor (TFT) substrate 30 on which pixel electrodes 21 and common electrodes 22 are formed, and a drive circuit 28 to supply a common voltage Vcom to common wire lines 24 and 25 of the TFT substrate 30. A plurality of data lines 27 and a plurality of gate lines 26 cross each other on the TFT substrate 30, and a TFT 23 is formed at each crossing part thereof. First common wire lines 24 are formed in a horizontal direction and connected to the common electrodes 22. Second common wire lines 25 are formed in a vertical direction and interconnect the first common wire lines 24 to the drive circuit 28. A source electrode of the TFT 23 is connected to the data line 27, a drain electrode is connected to a pixel electrode 21, and a gate electrode is connected to the gate line 26.

The drive circuit 28 converts digital image data into analog data voltages to be supplied to the data lines 27. The driving circuit 28 also supplies a common voltage Vcom to the second common wire lines 24. The common voltage Vcom supplied through the second common wire lines 24 is supplied to the common electrodes 22 through the first common wire lines 24. The liquid crystal cells are driven by an effective potential caused by a difference between the common voltage Vcom applied to the common electrodes 22 and pixel voltages applied to the pixel electrodes 21, thereby modulating light.

To reduce the data voltage in the IPS mode, a line inversion system is used where the data voltage of the same polarity is supplied to the liquid crystal cells of the same horizontal line while the data voltage of opposite polarities is supplied to the vertically adjacent liquid crystal cells. The common voltage Vcom of the line inversion system is generated as an AC voltage, which is inverted to a high voltage and a low voltage for each one horizontal period to reduce the swing width of the analog data voltage supplied to the data line 27.

In such an IPS mode LCD device, if a gap between the pixel electrode 21 and the common electrode 22 is lengthened to increase the aperture ratio, the effective potential of the liquid crystal cell needs to be increased accordingly by either increasing the data voltage or the common voltage Vcom. However, doing so increases the cost of the drive circuit while also increasing the power consumption of the device.

SUMMARY OF THE INVENTION

Accordingly, the present invention is directed to a liquid crystal display (LCD) that substantially obviates one or more problems due to limitations and disadvantages of the related art.

An object of the present invention is to provide an LCD with increased aperture ratio.

Another object of the present invention is to provide an LCD with increased effective potential of a liquid crystal cell.

To achieve these and other advantages and in accordance with the purpose of the present invention, as embodied and broadly described, a liquid crystal display device includes a plurality of pixel electrodes to which a data voltage is supplied, a plurality of common electrodes arranged to form electric fields with the pixel electrodes, a plurality of common wire lines commonly connected to the common electrodes in each horizontal line, a plurality of common voltage drive circuits to supply a common voltage to each of the corresponding common wire lines, and a controller for generating clock signals to control the common voltage drive circuits to invert an electric potential of the common voltage to be output from each of the common voltage drive circuits for each frame period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1A:
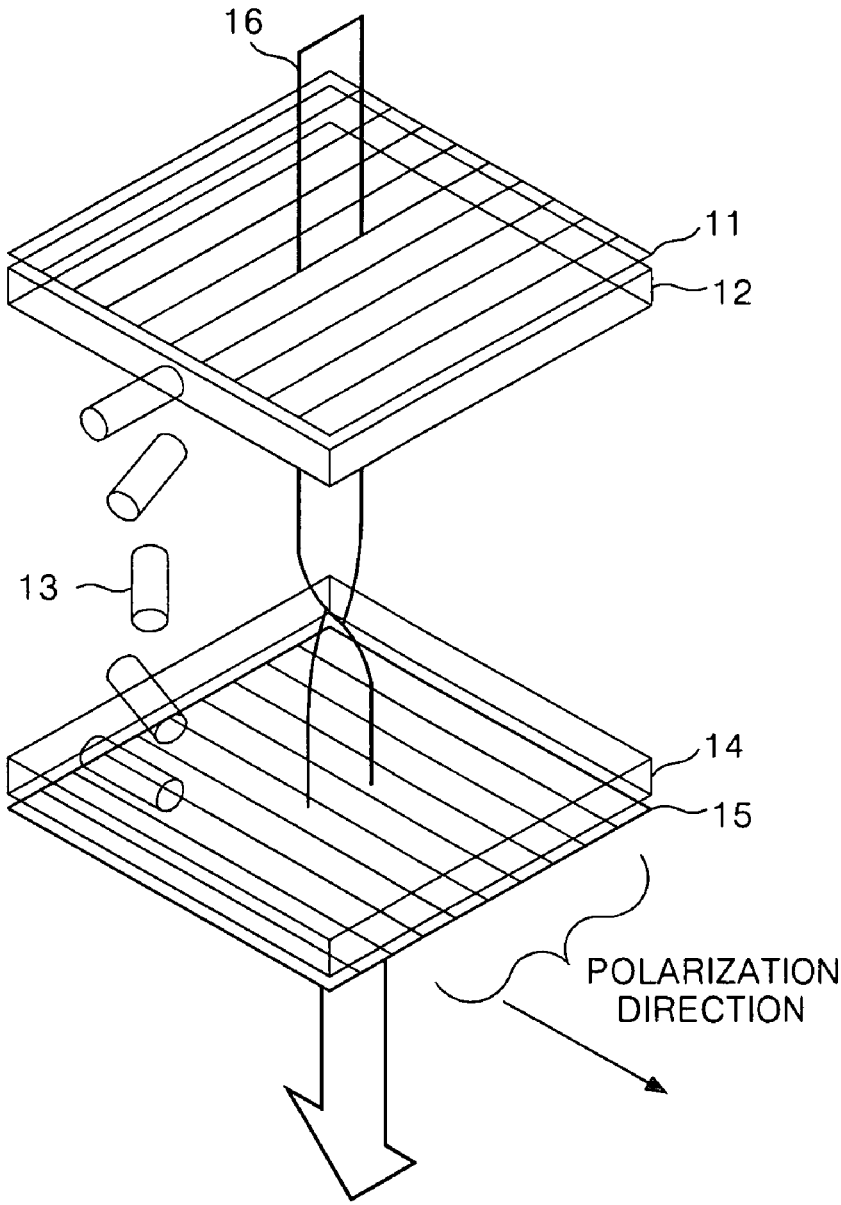
FIG.1A RELATED ART
FIGS. 1A and 1B are diagrams representing a twisted nematic (TN) mode of a related art.
Figure 1B:
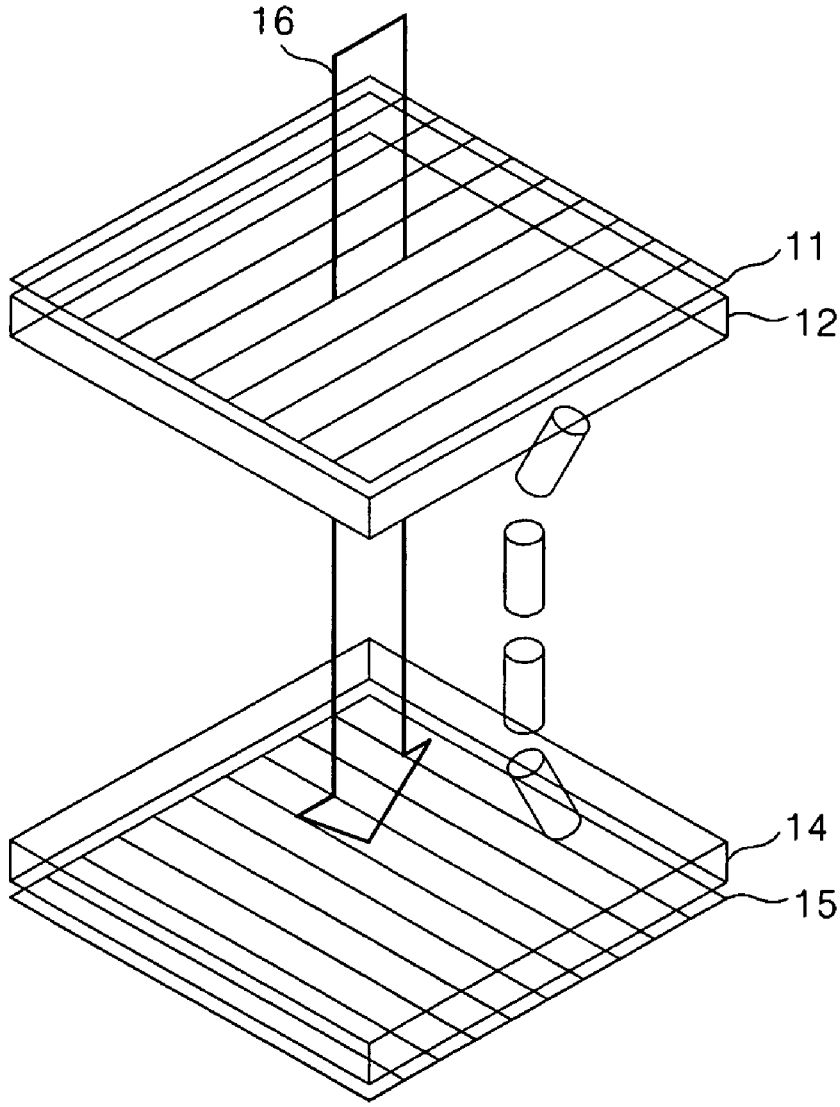
FIG. 1B RELATED ART
Figure 2:
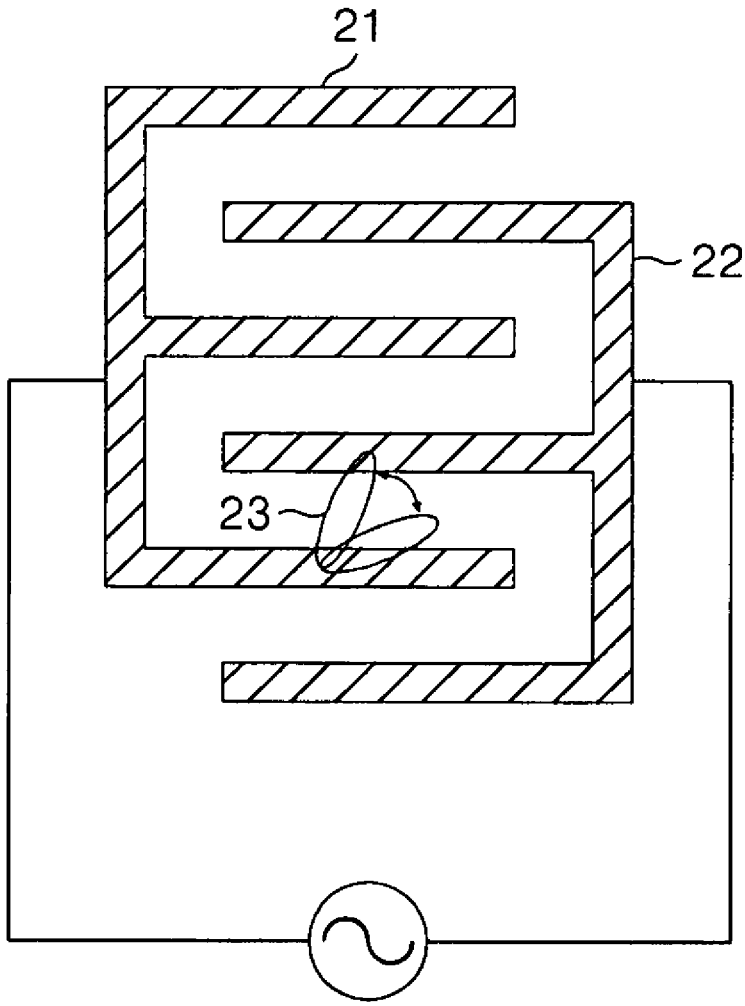
FIG. 2 RELATED ART
FIG. 2 is a diagram representing an in-plane switching (IPS) mode of the related art.
Figure 3:
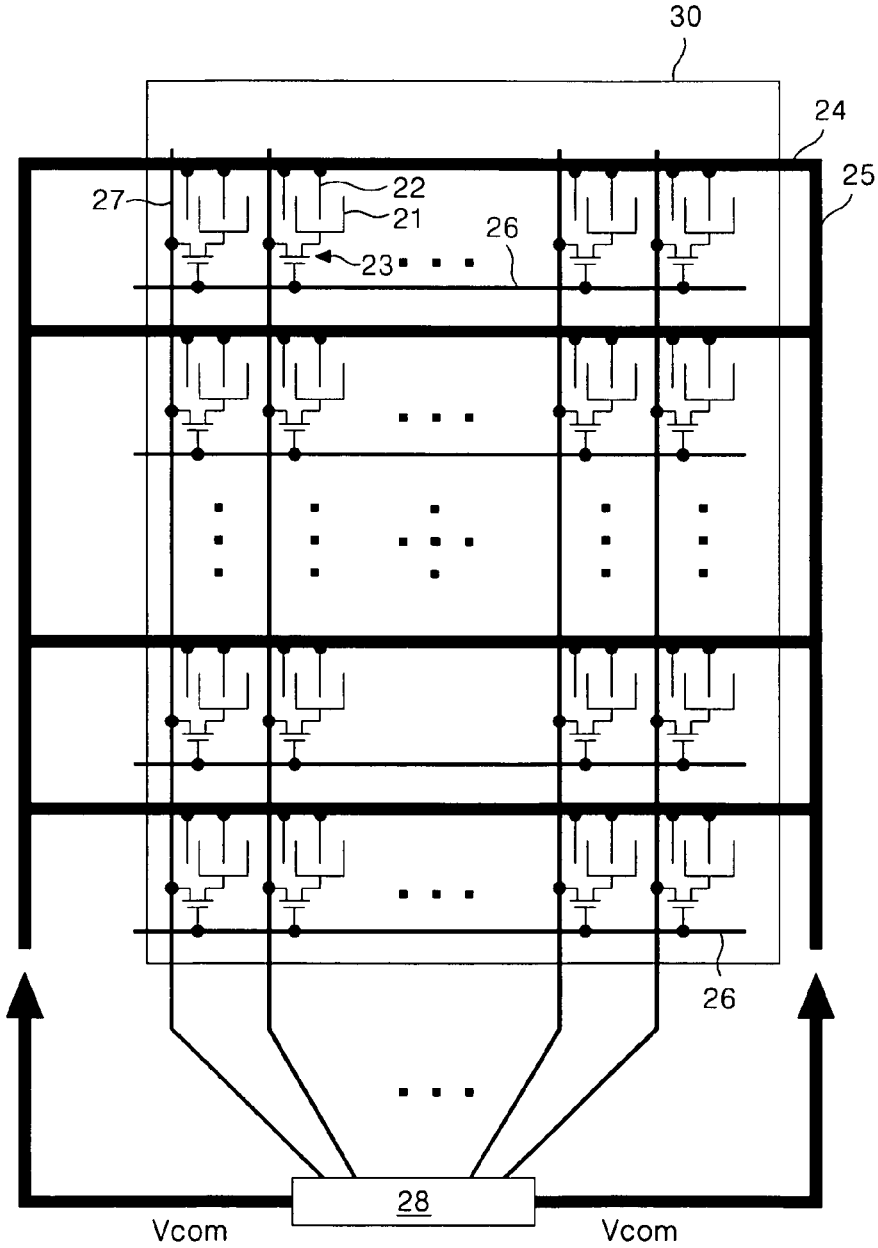
FIG.3 RELATED ART
FIG. 3 is a diagram representing an LCD device of in-plane switching mode of the related art.
Figure 4:
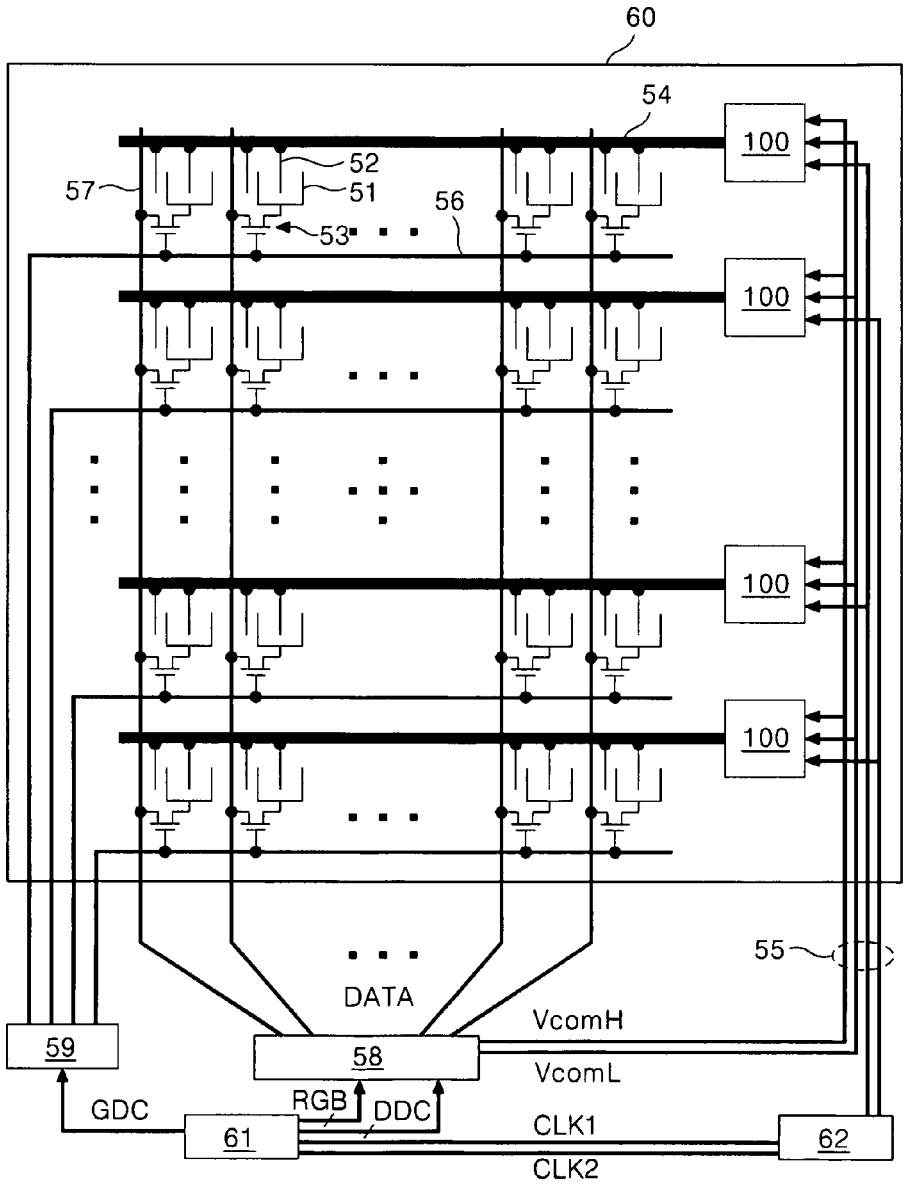
FIG. 4 is a diagram representing an LCD device according to an exemplary embodiment of the present invention.

As shown in FIG. 4, a liquid crystal display (LCD) device according to an exemplary embodiment of the present invention includes a TFT substrate 60 on which pixel electrodes 51 and common electrodes 52 are formed in-plane to generate a horizontal electric field. The TFT substrate 60 also includes common wire lines 54 spaced apart from each other and connected to the common electrodes 52, and Vcom drive circuits 100 to individually supply a common voltage Vcom to the common wire lines 54. A data drive circuit 58 is connected to data lines 57 to supply analog data voltages to the data lines 57. A gate drive circuit 59 is connected to gate lines 56 to sequentially supply a scan pulse to the gate lines 56. A timing controller 61 controls the drive circuits 58, 59, and 100, and a level shifter 62 is connected between the timing controller 61 and the Vcom drive circuits 100.

Specifically, TFT substrate 60 includes the pixel electrodes 51, the common electrodes 52, the data lines 57, the common wire line 54 connected to the common electrodes 52, Vcom control wire lines 55 connected between the Vcom drive circuit 100 and the data drive circuit 58, and gate lines 56. TFTs 53 are formed at the crossing parts of the data lines 57 and the gate lines 56. A source electrode of the TFT 53 is connected to the data line 57, a drain electrode is connected to the pixel electrode 21, and a gate electrode is connected to the gate line 56. Further, a plurality of storage capacitors (not shown) is formed on the TFT substrate 60 to sustain a voltage of each liquid crystal cell. Additionally, the Vcom drive circuit 100, which is formed on an amorphous silicon substrate, is embedded in one side of the TFT substrate 60.

The timing controller 61 receives digital video data RGB, a horizontal synchronization signal (H), a vertical synchronization signal (V), and a clock signal CLK, and generates a gate control signal GDC to control the gate drive circuit 59 and a data control signal DDC to control the data drive circuit 58. The data control signal DDC includes a source shift clock SSC, a source start pulse SSP, a polarity control signal POL, a source output enable signal SOE, and other data control signals and is supplied to the data drive circuit 58. The gate control signal GDC includes a gate start pulse GSP, a gate shift clock GSC, a gate output enable GOE, and other gate control signals and is supplied to the gate drive circuit 59. Further, the timing controller 61 supplies the digital video data RGB to the data drive circuit 58 and generates clock signals CLK1 and CLK2 to control the Vcom drive circuit 100.

The level shifter 62 receives the clock signals CLK1 and CLK2 from the timing controller 61. The level shifter 62 shifts the clock signals CLK1 and CLK2, which are TTL voltage levels, to a voltage level that is suitable for driving amorphous silicon TFTs. The shifted clock signals are supplied to the Vcom drive circuits 100.

The gate drive circuit 59 includes a shift register (not shown) to sequentially generate a scan pulse in response to the gate control signal GDC from the timing controller 61, a level shifter (not shown) for shifting a swing width of the scan pulse to a level suitable for driving a liquid crystal cell, an output buffer (not shown), and other suitable components. The gate drive circuit 59 supplies the scan pulse to the gate lines 56. Thus, the TFTs connected to the gate line 56 are switched on sequentially to select the liquid crystal cells of one horizontal line to which a pixel voltage of data, i.e., the analog data voltage, is to be supplied. The analog data voltage generated from the data drive circuit 58 is supplied to the liquid crystal cells in the horizontal line selected by the scan pulse.

The data drive circuit 58 supplies the analog data voltages to the data lines 57 in response to the data drive control signal DDC received from the timing controller 61. The data drive circuit 58 samples digital video data RGB from the timing controller 61, latches the data, and then converts the data into the analog data voltages. The data drive circuit 58 supplies first and second common voltages VcomH and VcomL to the Vcom drive circuits 100 through the Vcom control wire lines 55.

The first common voltage VcomH is a voltage that is higher than a high potential voltage of an AC drive voltage generated in the related art line inversion system. Similarly, the second common voltage VcomL is a voltage that is lower than the high potential voltage of the AC drive voltage generated in the related art line inversion system. The first common voltage VcomH is supplies to odd-numbered common wire lines 54 via the Vcom drive circuits 100 for an odd-numbered frame (1 frame=16.67 ms in an NTSC system) and is supplied to even-numbered common wire lines 54 for an even-numbered frame. The second common voltage VcomL is supplied to the even-numbered common wire lines 54 via the Vcom drive circuits 100 for the odd-numbered frame and is supplied to the odd-numbered common wire lines 54 for the even-numbered frame.

Figure 5:
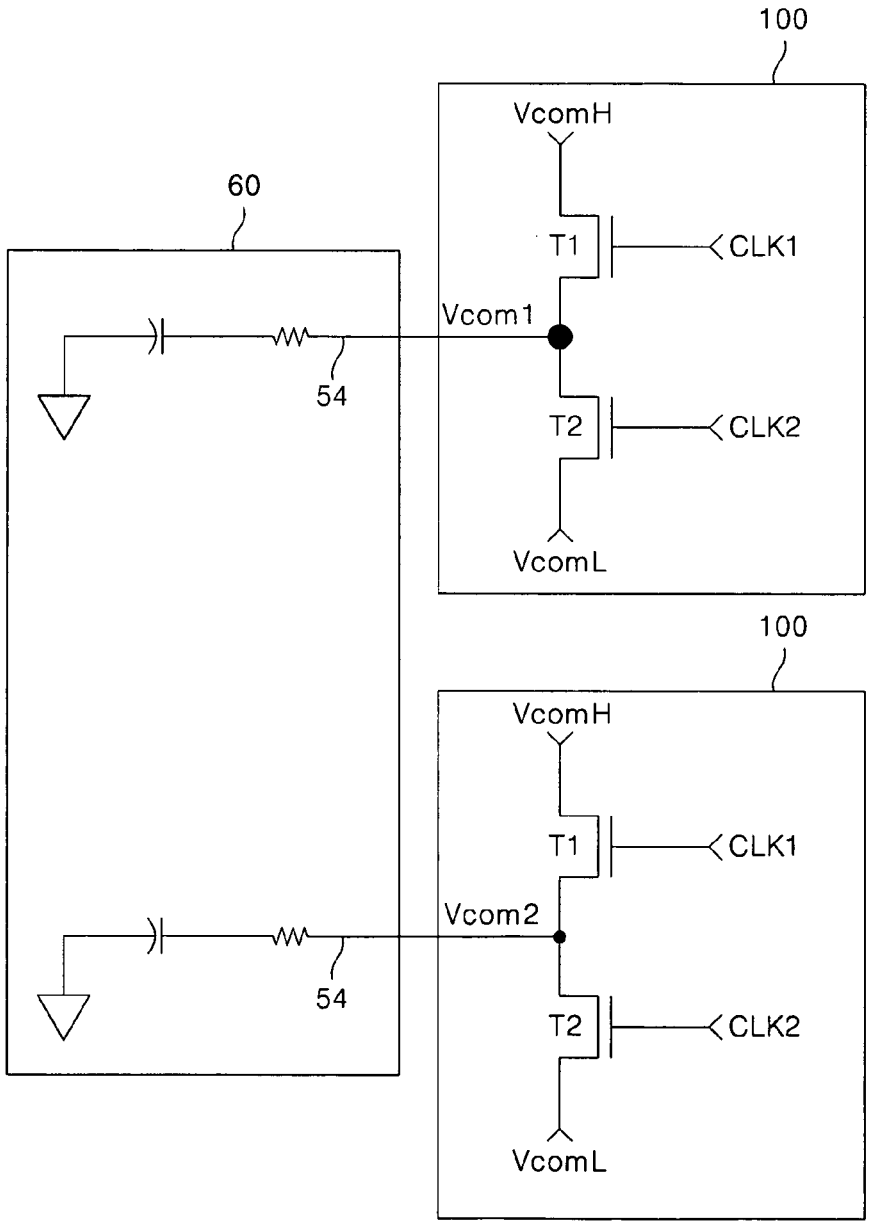
FIG. 5 is a circuit diagram representing an exemplary Vcom drive circuit of FIG. 4.

FIG. 5 illustrates an exemplary embodiment of the Vcom drive circuit 100 of FIG. 4. As shown, the Vcom drive circuit 100 includes a first transistor T1 to supply the first common voltage VcomH of high potential to the corresponding common wire line 54 in response to the first clock signal CLK1 and a second transistor T2 to supply the second common voltage VcomL of low potential to the common wire line 54 in response to the second clock signal CLK2. The first and second transistors T1, T2 are implemented in an n-type MOSFET, for example. However, other types of transistors may be used.

In particular, the first common voltage VcomH is supplied to a drain terminal of the first transistor T1 and the first clock signal CLK1 is supplied to a gate terminal. A source terminal of the first transistor T1 is connected to the common wire line 54. The second common voltage VcomL is supplied to a source terminal of the second transistor T2 and the second clock signal CLK2 is supplied to a gate terminal. A drain terminal of the second transistor T2 is connected to the common wire line 54. The Vcom drive circuits 100 drive each of the separated common wire lines 54 individually to increase a swing width of the common wire line, thereby increasing an effective potential of the liquid crystal cell.

Figure 6:
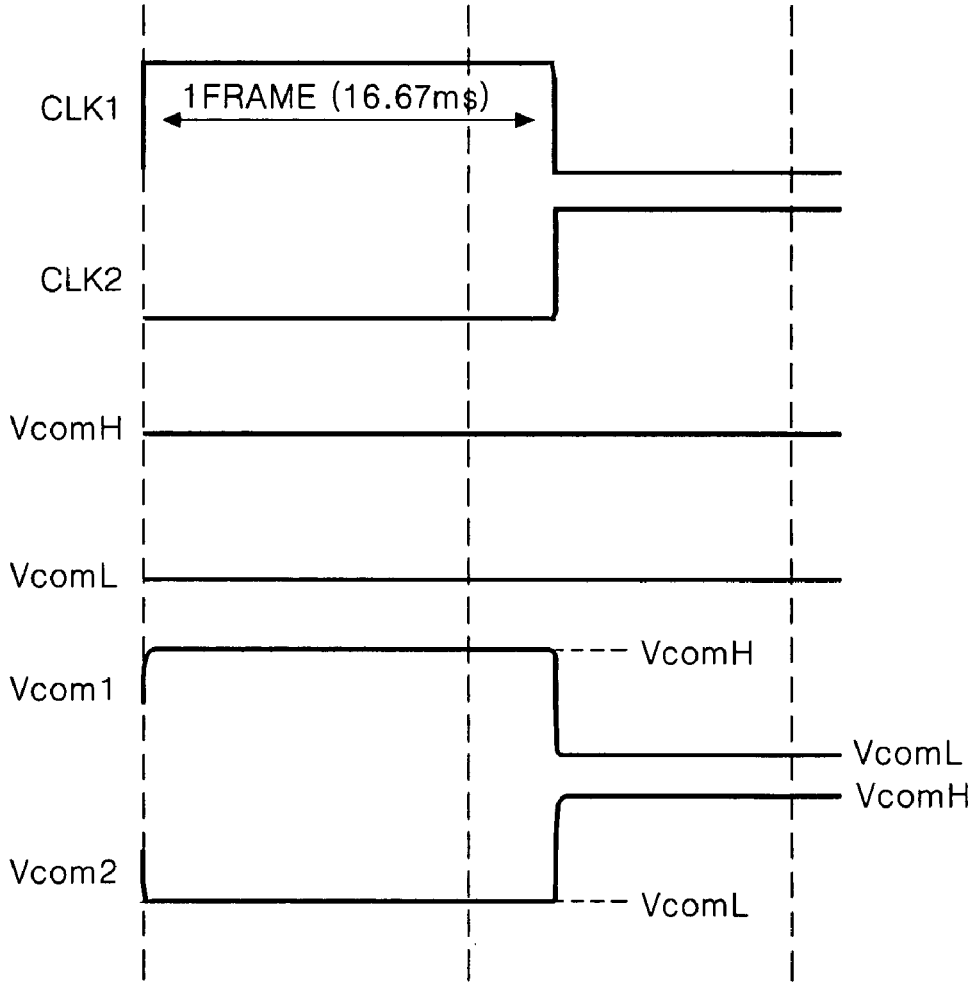
FIG. 6 is a waveform diagram showing an input/output waveform of the Vcom drive circuit of FIG. 5 according to the exemplary embodiment of the present invention.

FIG. 6 graphically represents common voltages VcomH, VcomL and input/output waveforms of the Vcom drive circuit 100. As shown, the clock signals CLK1, CLK2 are generated having reverse phases and their potentials are inverted for each frame period. The common voltages VcomH, VcomL are generated as DC voltages. Each of the Vcom drive circuits 100 supplies either the first common voltage VcomH or the second common voltage VcomL to the corresponding common wire line 54 such that the potentials of adjacent common wire lines 54 are different from each other. Here, the clock signals CLK1, CLK2 are reverse in phase with each other, thereby inverting the voltages for each frame.

For example, the first Vcom drive circuit 100 connected to the first common wire line 54 supplies the first common voltage VcomH of high potential to the first common wire line 54 of the first horizontal line during the odd-numbered frame period. At the same time, a negative analog data voltage is supplied by the data drive circuit 58 to the pixel electrodes of the liquid crystal cells included in the first horizontal line. Subsequently, the first Vcom drive circuit 100 supplies the second common voltage VcomL of low potential to the first common wire line 54 during an even-numbered frame period. At the same time, a positive analog data voltage is supplied to the pixel electrodes of the liquid crystal cells included in the first horizontal line.

In the meantime, the second Vcom drive circuit 100 connected to the second common wire line 54 supplies the second common voltage VcomL of low potential to the second common wire line 54 of the second horizontal line during the odd-numbered frame period. At the same time, a positive analog data voltage is supplied by the data drive circuit 58 to the pixel electrodes of the liquid crystal cells included in the second horizontal line. Subsequently, the second Vcom drive circuit 100 supplies the second common voltage VcomH of high potential to the second common wire line 54 during the even-numbered frame period. At the same time, a negative analog data voltage is supplied to the pixel electrodes of the liquid crystal cells included in the second horizontal line.

As a result, the IPS mode according to the present invention is driven in a line inversion manner by alternately applying the first and second common voltages VcomH, VcomL of the DC voltage for each line and inverting the polarity of the data for each line. As a result, the swing width of the common voltage is increased, which in turn increases the effective potential of the liquid crystal cell. As described above, the LCD device according to the present invention increases the aperture ratio in the IPS mode and the effective potential of the liquid crystal cell.

It will be apparent to those skilled in the art that various modifications and variations can be made in the LCD device of the present invention without departing form the spirit or scope of the invention. Thus, it is intended that the present invention cover the modifications and variations of this invention provided they come within the scope of the appended claims and their equivalents.

What is claimed is:

1. A liquid crystal display device having a thin film transistor substrate, comprising:

a plurality of pixel electrodes to which a data voltage is supplied;

a plurality of common electrodes arranged to form horizontal electric fields with the pixel electrodes;

a plurality of common wire lines commonly connected to the common electrodes in each horizontal line;

a plurality of common voltage drive circuits to supply a first and second common voltage to each of the corresponding common wire lines in response to the clock signals for each frame period; and a controller to generate clock signals which control the common voltage drive circuits that invert an electric potential of the common voltage to be output from each of the common voltage drive circuits for each frame period, wherein the pixel electrodes, the common electrodes, the common wire lines, and the common voltage drive circuits are formed on the thin film transistor substrate, wherein each of the common voltage drive circuits includes a first transistor and a second transistor commonly connected to the common wire line, wherein a gate electrode of the first transistor is connected to a first clock signal line, a drain electrode of the first transistor is connected to a first common voltage line, and a source electrode of the first transistor is connected to the common wire line, and a gate electrode of the second transistor is connected to a second clock signal line, a source electrode of the second transistor is connected to a second common voltage line, and a drain electrode of the second transistor is connected to the common wire line, wherein the plurality of common voltage drive circuits to supply a first and second common voltage to each of the corresponding common wire lines in response to the clock signals for each frame period comprising a first common drive circuit of the plurality of common voltage drive circuits is connected to a first common wire line of the plurality of common wire lines supplies the first common voltage of high potential to the first common wire line of the first horizontal line during an odd-numbered frame period and a negative analog data voltage is supplied by the data drive circuit to the pixel electrodes of a liquid crystal cells included in the first horizontal line and, subsequently the first common drive circuit is supplied the second common voltage of low potential to the first common wire line during an even-numbered frame period and a positive analog data voltage is supplied to the pixel electrodes of the liquid crystal cells included in the first horizontal line, a second common drive circuit of the plurality of common voltage drive circuits is connected to a second common wire line of the plurality of common wire lines supplies the second common voltage of low potential to the second common wire line of the second horizontal line during the odd-numbered frame period and the positive analog data voltage is supplied by the data drive circuit to the pixel electrodes of the liquid crystal cells included in the second horizontal line and, subsequently the second common drive circuit is supplies the second common voltage of high potential to the second common wire line during the even-numbered frame period and the negative analog data voltage is supplied to the pixel electrodes of the liquid crystal cells included in the second horizontal line.

2. The liquid crystal display device according to claim 1, further including a level shifter to shift a voltage level of a clock signal generated from the controller and to supply the shifted clock signal to the common voltage drive circuits.

3. The liquid crystal display device according to claim 1, further including:

a plurality of data lines;

a plurality of gate lines that cross the data lines;

a plurality of thin film transistors to supply a data voltage from the data line to the pixel electrodes in response to a scan voltage on the gate lines;

a data drive circuit to convert a digital image data into an analog data voltage to be supplied to the data lines; and a gate drive circuit to sequentially supply the scan voltage to the gate lines, wherein the controller controls the data drive circuit and the gate drive circuit.

4. The liquid crystal display device according to claim 3, wherein the data drive circuit supplies first and second common voltages to the common voltage drive circuits.

5. The liquid crystal display device according to claim 4, wherein the data drive circuit generates analog data voltages of the same polarity corresponding to liquid crystal cells that are horizontally adjacent, and analog data voltages of opposite polarities corresponding to liquid crystal cells that are vertically adjacent.

* * * * *